United States Patent [19]

Zimmerli et al.

[11] Patent Number: 4,646,548

[45] Date of Patent: Mar. 3, 1987

[54] TUBE EXPANDING AND GROOVING TOOL AND METHOD

[75] Inventors: Robert H. Zimmerli, Weedsport; Alexander T. Lim, North Syracuse, both of N.Y.

[73] Assignee: Carrier Corporation, Syracuse, N.Y.

[21] Appl. No.: 660,577

[22] Filed: Oct. 12, 1984

Related U.S. Application Data

[63] Continuation-in-part of Ser. No. 427,408, Sep. 29, 1982, abandoned.

[51] Int. Cl.[4] ..... B21D 39/20; B21D 53/00

[52] U.S. Cl. ..... 72/68; 29/157.3 A; 29/157.3 AH; 29/523

[58] Field of Search ..... 72/68, 112, 118, 114, 72/283, 474, 367, 370, 70, 71, 96, 97, 276, 278, 256; 29/157.3 A, 157.3 AH, 157.3 B, 523, 157.3 R

[56] References Cited

U.S. PATENT DOCUMENTS

| | | | |
|---|---|---|---|
| 1,465,073 | 8/1923 | Davis | 72/97 |
| 1,646,384 | 10/1927 | Bergstrom | 29/157.3 A |
| 2,004,389 | 6/1935 | Jones | 29/157.3 AH |
| 2,145,588 | 1/1939 | Findlater | 72/97 |
| 2,363,476 | 11/1944 | Bannister | 72/97 |
| 4,031,738 | 6/1977 | Schonfield et al. | 72/209 |
| 4,248,179 | 2/1981 | Bonner | 29/157.3 AH |

FOREIGN PATENT DOCUMENTS

| | | | |
|---|---|---|---|
| 305023 | 7/1919 | Fed. Rep. of Germany | . |
| 301272 | 7/1919 | Fed. Rep. of Germany | . |
| 648920 | 8/1937 | Fed. Rep. of Germany | 29/157.3 B |
| 1028353 | 11/1950 | France | . |
| 14452 | 2/1978 | Japan | 29/157.3 AH |
| 130351 | 10/1980 | Japan | 29/157.3 B |
| 130352 | 10/1980 | Japan | 29/157.3 B |
| 149737 | 11/1980 | Japan | 29/157.3 B |
| 19939 | 2/1981 | Japan | 29/157.3 A |
| 139225 | 10/1981 | Japan | 72/283 |
| 97445 | 6/1983 | Japan | 29/157.3 AH |
| 173043 | 10/1983 | Japan | 29/157.3 A |
| 188519 | 11/1983 | Japan | 72/71 |

OTHER PUBLICATIONS 57-72730, Patent Abstracts of Japan, vol. 8, No. 32, (M-275), (1469), 2/10/84.

*Primary Examiner*—Lowell A. Larson
*Attorney, Agent, or Firm*—David J. Zobkiw

[57] ABSTRACT

A method and a tool for expanding the outside diameter and forming grooves on the inside surface of a tube. The tool comprises an axially extending mandrel, a centering portion, and a grooving portion. The centering and grooving portions of the tool are both secured to the mandrel, with the grooving portion located axially rearward of the centering portion. The centering portion radially projects outward of the mandrel, and the grooving portion is coaxial with and radially projects outward of the central portion of the tool. The central portion defines a smooth annular surface to engage and partially expand the tubes, inside and outside diameters, to guide the tube onto the grooving portion, and to maintain the grooving portion centered within the tube. The grooving portion defines an outside surface to expand the tube further, and preferably includes a plurality of external fins to form grooves on the inside surface of the tube.

6 Claims, 5 Drawing Figures

TUBE EXPANDING AND GROOVING TOOL AND METHOD

BACKGROUND OF THE INVENTION

This is a continuation-in-part of application Ser. No. 427,408 filed Sept. 29, 1982, now abandoned.

This invention generally relates to tube expanding and grooving, and more specifically to a tool and a method especially well suited for simultaneously expanding the outside diameter and forming internal grooves in soft, thin walled tubes.

Heat exchange tubes, for example those used in refrigeration or air conditioning equipment, are often provided with internal grooves to enhance the heat transfer characteristics of the tubes, and many methods and apparatus are well known for forming grooves on the inside surface of a tube. Also, heat exchange tubes are often expanded into pressure engagement with plate fins to connect the tubes thereto in good heat transfer relation with the plate fins, and arrangements are known for doing this.

When it is desired both to expand the outside diameter of a tube and to form internal grooves therein, this is typically done via separate expanding and grooving operations. That is, the tube is first grooved and then expanded. While satisfactory results may be obtained in this manner, it is time consuming and thus expensive as well as inefficient since the grooved tube looses a significant amount of its enhancement when subsequently expanded. For this reason, efforts have been undertaken to study methods and apparatus for simultaneously expanding and forming grooves on the inside surface of a tube.

Particular difficulties have been encountered in providing methods and apparatus that will simultaneously expand and form internal grooves in soft and thin walled tubes such as soft aluminum and copper. To elaborate, grooves may be formed on the inside surface of a tube by passing a tool through the tube where the tool has external ridges or fins of increasing diameter to engage the tube sidewall material. These fins exert radial, longitudinal and tangential pushing forces on the tube wall material, expanding the outside diameter and forming tube wall material with the fins to make grooves in the tube wall and to cause the outer surface of the tubes, to secure the plate fins in place and in good heat transfer contact with the tube.

A SUMMARY OF THE INVENTION

An object of the present invention is to provide a tool and a method that may be effectively employed to simultaneously expand the outside diameter and form grooves on the inside surfaces of soft and thin walled tubes.

Another object of this invention is to precede a tube grooving portion of a tool through a tube with a tool centering portion defining a smooth outside annular surface to expand the tube partially, to guide the tube onto the grooving portion, and to facilitate maintaining the tool centered within the tube.

It is a further object of this invention to provide a method and apparatus for internally enhancing and expanding the outside diameter of a tube so as to expand the tube into locking contact with surrounding fins.

It is an additional object of this invention to provide a method and apparatus for providing internal grooves with larger lead angles in a tube while expanding the outside diameter of the tube.

It is a still further object of this invention to provide a method and apparatus for expanding the outside diameter and internally grooving a tube in a continuous deformation.

It is another object of this invention to expand the outside diameter and internally groove a tube by forming, rather than cutting, the tube material.

These and other objects are attained with a tool for expanding the outside diameter and forming grooves on the inside surface of a tube comprising an axially extending mandrel, a centering portion, and a grooving portion. The centering and grooving portions of the tool are both secured to the mandrel, with the grooving portion located axially rearward of the centering portion. The centering portion radially projects outward of the mandrel, and the grooving portion is coaxial with and radially projects outward of the centering portion of the tool. The centering portion defines a smooth annular surface to engage and internally smooth while partially expanding the tube, to guide the tube onto the grooving portion, and to maintain the grooving portion centered within the tube. The grooving portion defines an outside surface to expand the tube further, and preferably includes a plurality of uniformly spaced external fins to form grooves on the inside surface of the tube. The first expansion initially expands the outer diameter of the tube to a touching or almost touching contact with the surrounding fins while the second expansion produces a locking of the fins onto the tube as well as good heat transfer contact between the fins and tube.

DETAILED DESCRIPTION OF THE PREFERRED EMBODIMENTS

Figure 1:
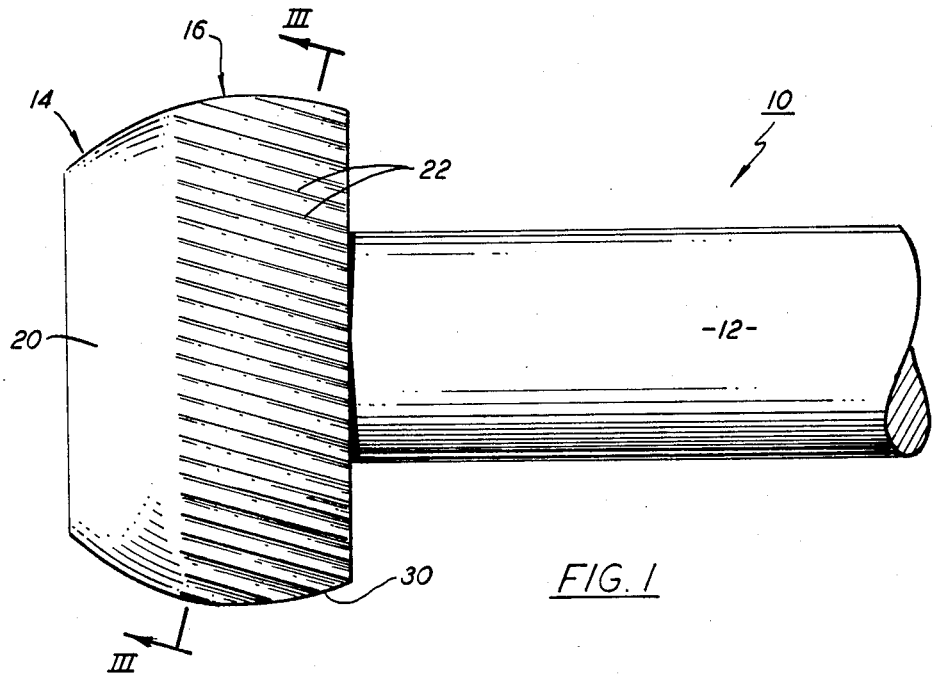
FIGS. 1 and 2 are side views of two tools constructed in accordance with the present invention.
Figure 2:
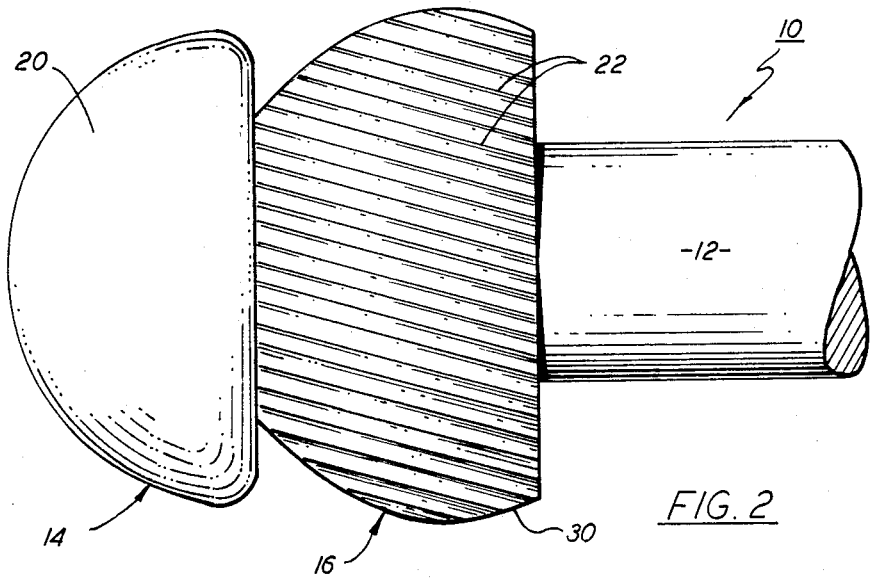
Figure 3:
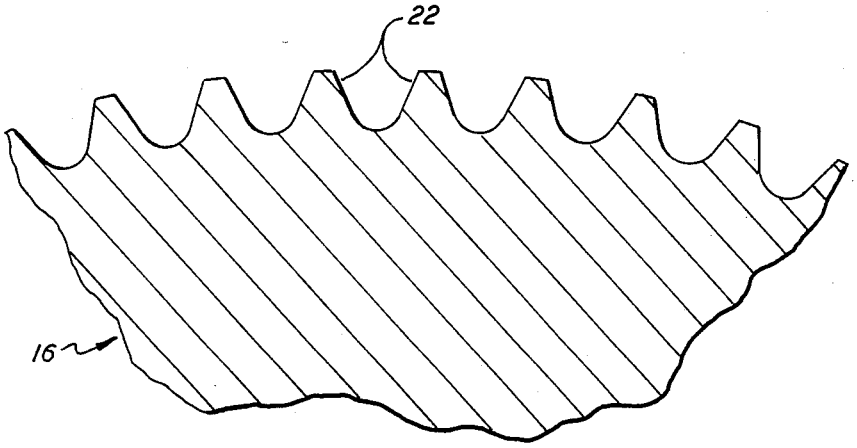
FIG. 3 is a fragmentary, cross-sectional view taken along line III—III of FIG. 1.
Figure 4:
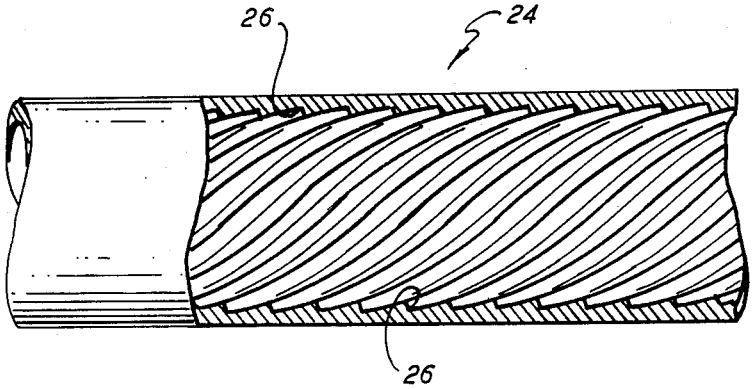
FIG. 4 is a side view, partially in cross-section, of a tube which has been expanded and grooved in accordance with the present invention.
Figure 5:
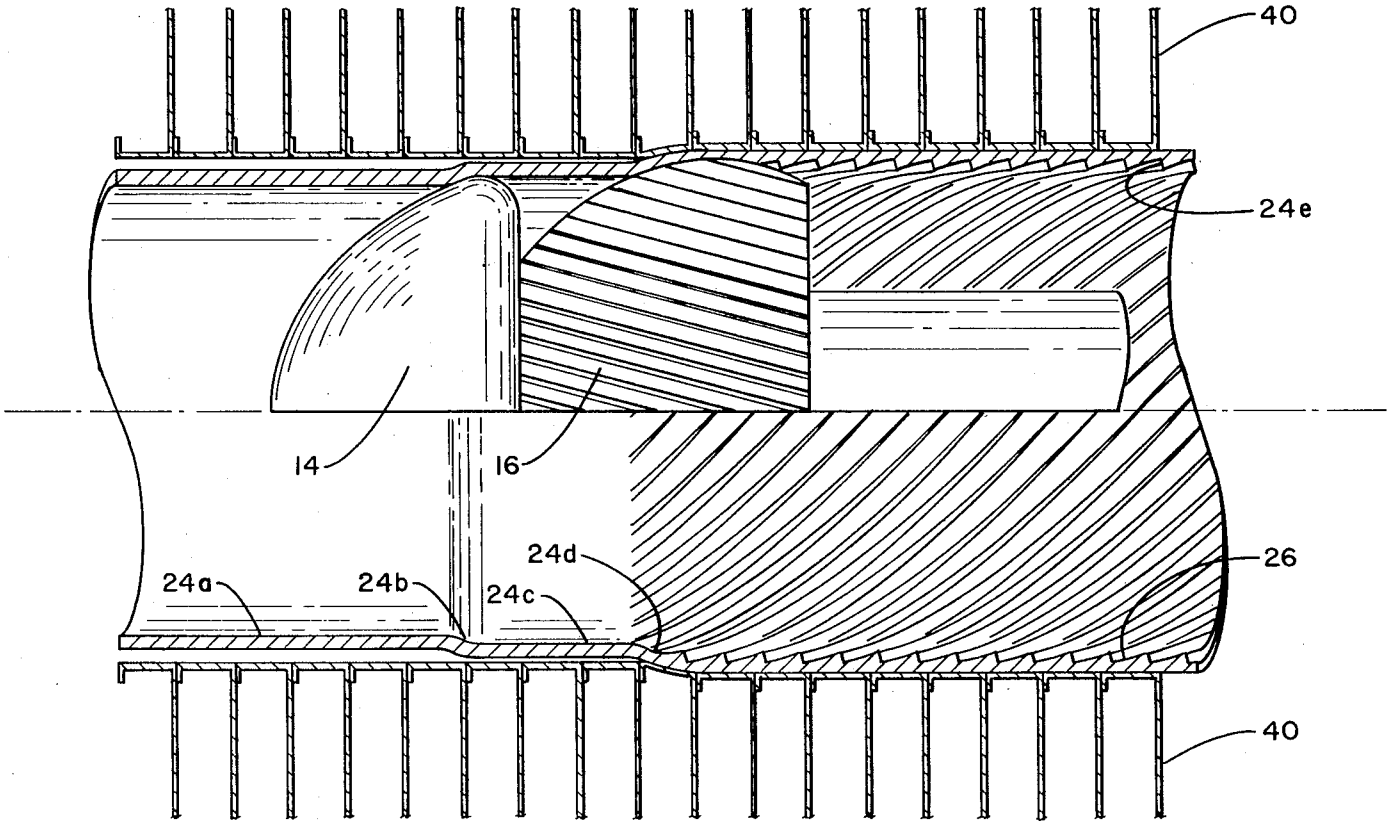
FIG. 5 is a sectional view of a tube being externally expanded into contact with plate fins in a coil in two stages while being internally grooved by the tool of FIG. 2.

FIGS. 1 and 2 disclose two embodiments of tool 10 for expanding the outside diameter and forming grooves on the inside surface of a tube. Generally, tool 10 comprises axially extending mandrel 12, centering and initial expanding portion 14, and final expanding and grooving portion 16. Centering portion 14 is secured to mandrel 12 and radially projects outward thereof. Grooving portion 16 is secured to mandrel 12, is located axially rearward of centering portion 14, and is coaxial with and radially projects outward of the centering portion. Centering portion 14 defines a smooth outside annular surface 20 to engage and internally smooth while partially expanding a tube, to guide the tube onto grooving portion 16, and to maintain the grooving portion centered within the tube. Grooving portion 16 defines an outside surface to expand the tube further, and preferably includes a plurality of uniformly spaced fins 22 to form grooves on the inside surface of the tube. An enlarged, cross-sectional view of fins 22 is shown in FIG. 3. The lead angle of the fins 22 and, therefore, the angle of the grooves can be at least 30°.

With the embodiment of tool 10 illustrated in FIG. 1, centering portion 14 and grooving portion 16 are integral portions of a single piece of material, which is located immediately forward of mandrel 12 and has a generally annular shape with a slightly convex outside surface. With the embodiment of tool 10 shown in FIG. 2, centering portion 14 and grooving portion 16 are separable. Grooving portion 16 is located immediately forward of mandrel 12 and has the shape of a truncated semi-sphere. Centering portion 14 is located immediately forward of grooving portion 16 and has a generally semi-spherical shape. With both embodiments of tool 10, centering portion 14 and grooving portion 16 may be rotatably secured to mandrel 12.

In operation, with reference to FIGS. 1, 2, 4 and 5, tool 10 is moved, either by being pushed or pulled, through a smooth bore tube or tube portion 24 such that centering and initial expanding portion 14 precedes grooving portion 16. The maximum diameter of centering portion 14 is greater than the inside diameter of the unexpanded portion 24*a* of tube 24 by, typically, 0.012 inches; and, as the centering portion passes therethrough, the centering portion of tool 10 engages the inside surface of portion 24*b* of the tube, gradually forcing the tube wall material outward, expanding the tube to an intermediate diameter portion 24*c*, and guides the tube onto grooving portion 16. The portion 24*c* is in touching or almost touching contact with the plate fins 40 of a coil.

Grooving portion 16 of tool 10 follows centering portion 14 through tube 24. As grooving portion 16 passes through tube 24, the grooving portion of tool 10 engages the inside surface of the intermediate diameter portion 24*c* of the tube and acts over portion 24*d* to further force the tube wall material outward, further expanding the tube 24 into heat transfer and locking contact with plate fins 40 at portion 24*e*; and, in particular, fins 22 engage the inside surface of the tube portion 24*d* and gradually force tube wall material out of their respective paths, expanding the outer diameter of the tube and forming grooves 26 on the inside surface of tube 24 partially by forcing tube material between fins 22 and partially by expanding the tube internally. In order to obtain helical grooves 26 on the inside surface of tube 24, fins 22 may be slanted relative to the longitudinal axis of tube 24 with a lead angle of up to at least 30°, causing the fins and grooving portion 16 to rotate about the longitudinal axis of the grooving portion of tool 10 as the tool is pushed or pulled through the tube.

It should be pointed out that the percentages of the total expansion of tube 24 caused by centering portion 14 and grooving portion 16 of tool 10 may be varied but expansion by centering portion 14 will predominate with a total expansion of 0.02 inches typical for plate fin applications. Also, centering portion 14 and grooving portion 16 may have profiles other than as shown in FIGS. 1 and 2, and it is not necessary to the practice of the present invention that fins 22 start to form grooves 26 in tube 24 immediately upon engagement with the tube side wall material. However, where the expansion and grooving produces continuous deformation, there is less cold working to make the second expansion and grooving more difficult.

With the process described above, as centering portion 14 of tool 10 passes through tube 24, because outside surface 20 of centering portion 14 is smooth, the forces between the centering portion 14 urging tube 24 radially outward and the tube urging the centering portion of tool 10 radially inward in a simple tube expansion. This is in distinct contrast to the forces between grooving portion 16 of tool 10 and tube 24, which, because the grooving portion includes external fins 22, involve significant axial and tangential, as well as radial, forces. Moreover, the forces on centering portion 14 tend to adjust automatically to maintain the axis of the centering portion of tool 10 centered within tube 24. That is, should the axis of centering portion 14 rise, for example, within tube 24, the centering portion of tool 10 engages the upper side of the tube with greater force than the lower side of the tube. This urges centering portion 14 downward, tending to return the axis thereof to the center of tube 24.

It is believed that the dominance of radial forces on centering portion 14, along with the above-described self-adjusting feature of those forces, substantially facilitate maintaining the centering portion of tool 10 centered within tube 24. Since centering portion 14 and grooving portion 16 of tool 10 are secured to mandrel 12 so as to maintain the axes of the centering and grooving portions of tool 10 aligned, maintaining the centering portion centered within tube 24 also maintains grooving portion 16 centered therewithin.

Further, it should be noted that as tube 24 passes over grooving portion 16 and fins 22 engage the tube sidewall portion 24*d* to further expand the tube and to form grooves 26, the thickness of the wall of the tube decreases, which tends to decrease the strength of the tube wall, but the fins 22 also harden the tube wall due to cold working, which tends to increase the tube wall strength. The net result of this is that the further expansion of tube 24 by grooving portion 16 of tool 10 is achieved with little or no net effect on the overall strength of the tube.

In certain applications, for example when used with tubes that have been bent into a U or hairpin shape, tool 10 is withdrawn from the tube by pulling the tube backwards through the tube. To facilitate this backward movement of tube 10, and in particular to prevent the back face of grooving portion 16 and the back ends of fins 22 from binding against the inside surface of the tube, preferably back segment 30 of grooving portion 16 tapers radially inward.

In summary, expansion takes place in two steps with the inner and outer diameters of the tube increasing in each step. As part of the second step of expansion, enhancement of the tube takes place by forming internal grooves in a forming operation which does not remove any of the material. The first expansion of a tube in a tube sheet expands the outer diameter of the tube to touching or almost touching contact with the plate fins while the second expansion forces the outer diameter of the tube into intimate contact with the plate fin collars to lock the plate fins in place and to produce good heat transfer between the tube and fins. Where the two expanding steps produce continuous deformation of the tube, cold working is reduced.

While it is apparent that the invention herein disclosed is well calculated to fulfill the objects stated above, it will be appreciated that numerous modifications and embodiments may be devised by those skilled in the art. For example, the members 14 and 16 may be frustums of cones rather being portions of a sphere. It is, therefore, intended that the appended claims cover all such modifications and embodiments as fall within the true spirit and scope of the present invention.

What is claimed is:

1. A method for internally grooving and for expanding the inside diameter and the outside diameter of a tube comprising the steps of:

subjecting a first portion of the interior surface of a tube to a primarily radial force to force tube material outwardly to increase and thereby expand the internal and external diameters of the tube; and simultaneously subjecting a second portion of the interior surface of the expanded tube to a combination of radial, axial and tangential forces to simultaneously force tube material outwardly to thereby further increase and expand the internal and external diameters of the tube and to form helically extending grooves in the interior surface of the tube.

2. The method of claim 1 wherein the external diameter of the tube increases more when subjected to the primarily radial force than when subjected to the combination of radial, axial and tangential forces.

3. A tool for externally expanding and for forming grooves on the inside surface of a tube, the tool comprising:

an axially extending mandrel;

a centering and first expansion portion secured to said mandrel and radially projecting outward thereof with an increasing radial dimension for at least a portion of its axial length;

a grooving and second expansion portion continuous with said centering and first expansion portion and located coaxial with and axially rearward of said centering and first expansion portion and radially projecting outward of said centering and first expansion portion with an increasing radial dimension for at least a portion of its axial length;

said centering and first expansion portion defining a smooth annular surface to engage and partially expand the tube to guide the tube onto the grooving and second expansion portion, and to maintain the grooving and second expansion portion centered within the tube; and said grooving and second expansion portion defining an outside surface continuous with said smooth annular surface to expand the tube further, and including external fins to form grooves on the inside surface of the tube.

4. The tool of claim 3 wherein said external fins are located at an angle of up to 30° with respect to the axis of said grooving and second expansion portion.

5. A method for internally grooving and for expanding the inside diameter and the outside diameter of a tube comprising the steps of:

subjecting the interior surface of a tube to a primarily radial force to force tube material outwardly to solely increase and thereby expand the internal and external diameters of the tube such that the outer diameter of the tube expands to a touching contact with surrounding plate fins; and subjecting the interior surface of the expanded tube to a combination of radial, axial and tangential forces to simultaneously force tube material outwardly to thereby further increase and expand the internal and external diameters of the tube such that the outer diameter of the tube expands into locking contact with the surrounding plate fins to secure the plate fins in place and to ensure good heat transfer contact between the tube and the plate fins and to form helically extending grooves in the interior surface of the tubes.

6. A tool for externally expanding and for forming grooves on the inside surface of a tube, the tool comprising:

an axially extending mandrel;

a centering and first expansion portion secured to said mandrel and radially projecting outward thereof with an increasing radial dimension for at least a portion of its axial length;

a grooving and second expansion portion secured to said mandrel in a spaced relationship with said centering and first expansion portion and located coaxial with and axially rearward of said centering and first expansion portion and radially projecting outwards with an increasing radial dimension for at least a portion of its axial length such that only a portion of said increasing radial dimension projects radially outwardly of said centering and first expansion portion;

said centering and first expansion portion defining a smooth annular surface to engage and partially expand the tube to guide the tube onto the grooving and second expansion portion, and to maintain the grooving and second expansion portion centered within the tube; and said grooving and second expansion portion defining an outside surface to expand the tube further, and including external fins to form grooves on the inside surface of the tube.

* * * * *